US009193548B2

(12) United States Patent
Kobayashi et al.

(10) Patent No.: US 9,193,548 B2
(45) Date of Patent: Nov. 24, 2015

(54) SHEET SUPPLY DEVICE AND IMAGE FORMING APPARTUS

(71) Applicant: KYOCERA Document Solutions Inc., Osaka (JP)

(72) Inventors: Yuya Kobayashi, Osaka (JP); Hideyuki Teramoto, Osaka (JP); Masayuki Mochizuki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/494,004

(22) Filed: Sep. 23, 2014

(65) Prior Publication Data

US 2015/0091243 A1 Apr. 2, 2015

(51) Int. Cl.

| | |
|---|---|
| ***B65H 7/14*** | (2006.01) |
| ***B65H 7/06*** | (2006.01) |
| ***B65H 3/06*** | (2006.01) |

(52) U.S. Cl.

CPC ..... *B65H 7/06* (2013.01); *B65H 3/0669* (2013.01); *B65H 3/0684* (2013.01); *B65H 7/14* (2013.01); *B65H 2513/511* (2013.01); *B65H 2601/121* (2013.01)

(58) Field of Classification Search

CPC ..... B65H 7/06; B65H 7/14; B65H 2513/51; B65H 2513/511; B65H 2601/121

USPC ..... 271/258.03

See application file for complete search history.

(56) References Cited

U.S. PATENT DOCUMENTS

| | | | | |
|---|---|---|---|---|
| 2005/0035526 | A1 * | 2/2005 | Yang et al. | 271/10.09 |
| 2007/0001388 | A1 * | 1/2007 | Able et al. | 271/258.01 |
| 2008/0292334 | A1 * | 11/2008 | Takahashi | 399/38 |
| 2009/0057986 | A1 * | 3/2009 | Yaginuma | 271/11 |
| 2011/0024978 | A1 * | 2/2011 | Nishikata et al. | 271/264 |
| 2013/0222505 | A1 * | 8/2013 | Akatsuka et al. | 347/110 |

FOREIGN PATENT DOCUMENTS

| | | | |
|---|---|---|---|
| JP | 2006-298616 | A | 11/2006 |
| JP | 2006-327736 | A | 12/2006 |
| JP | 2007-22738 | A | 2/2007 |

* cited by examiner

*Primary Examiner* — Patrick Cicchino

(74) *Attorney, Agent, or Firm* — Stein IP, LLC

(57) ABSTRACT

The pickup roller is placed above a lifting plate made of a flexible material and feeds the sheet with abutting on an upper surface of the sheets loaded on the lifting plate. The sensor detects an arrival of the sheet fed by the pickup roller on a downstream side of the pickup roller. The abnormality detection unit detects the sheet feeding abnormality of the sheet fed by the pickup roller based on the drive start time of the pickup roller and the time sheet detection by the sensor. The abnormality detecting condition correction unit corrects the abnormality detecting condition of the abnormality detection unit depending on the amount of sheets on the lifting plate.

8 Claims, 7 Drawing Sheets

| THE NUMBER OF PAPERS (SHEET) | α (ms) |
|---|---|
| ~100 | 0 |
| 101~150 | 5 |
| 151~250 | 10 |
| 251~300 | 15 |

| THE NUMBER OF CONVEYED PAPERS (SHEET) | β (ms) |
|---|---|
| 0~9999 | 0 |
| 10000~19999 | 10 |
| 20000~29999 | 20 |
| 30000~39999 | 30 |
| 40000~49999 | 40 |
| ⋮ | ⋮ |

SHEET SUPPLY DEVICE AND IMAGE FORMING APPARTUS

CROSS-REFERENCE TO RELATED APPLICATIONS

This application claims the benefit of priority to Japanese Patent Application No. 2013-201887 filed on Sep. 27, 2013, all of which is hereby incorporated by reference in its entirety.

BACKGROUND OF THE INVENTION

The present disclosure relates to a sheet supply device for supplying a sheet like a paper, and an image forming apparatus.

The sheet supply device is widely applied to the image forming apparatus like the copying machine, the facsimile machine, the scanner, and the multifunction apparatus. Using the sheet supply device, the sheets like papers to transfer an original image thereon are conveyed one by one to a position to form the image thereon, whereby the image forming apparatus can print each image successively.

The sheet supply device is configured so that a sheet bundle abuts on a pickup roller in order that a plurality of sheets stacked onto a tray is fed one by one. A thickness of sheet bundle depends on the number of sheets stacked on the tray. Accordingly, a distance between a sheet stacking surface and the pickup roller should be adjusted according to the thickness of sheet bundle, in order to allow the sheet bundle to abut on the pickup roller properly. A lifting plate liftably mounted on the sheet stacking surface can be used for such adjustment. In the sheet supply device, the sheet bundle on the lifting plate is pushed up by the lifting plate, and the sheet bundle abuts on the pickup roller. The pickup roller sends out the sheet abutting on the pickup roller.

There are various kinds of techniques for materializing a stable sheet feeding in such sheet supply device. For instance, one configuration is disclosed wherein a torsion spring is employed as a lifting member for lifting up the lifting plate, and the elastic deformation of the torsion spring is changed depending on the paper remaining amount so that the force pushing up the lifting plate can be varied. In this configuration, it is possible to generate an almost constant feeding pressure (the force pushing sheet bundle against the pickup roller) regardless of the change of the loading weight from the full loading to the last sheet.

In addition, another configuration is disclosed wherein a plurality of elastic members is employed as the lifting member for lifting up the lifting plate. In such configuration, the force for lifting up the lifting plate can be varied by using an elastic member for generating a linear elastic force and the other elastic member for generating a non-linear elastic force.

Moreover, there is another configuration to suppress the conveyance skid by increasing the feeding pressure when the time for the fed sheet to arrive at the position to detect the paper arrival is longer than the specific time.

The image forming apparatus such as the printers has been requested to improve the image forming speed (the printing speed). On that account, since the sheet supply device is also needed to improve the paper feeding speed, the rotating speed (peripheral speed) of the pickup roller is increased. Where the rotating speed of the pickup roller is increased, the frictional force, which is generated between the pickup roller and the uppermost paper at the start of the pickup roller rotation, also tends to increase.

Moreover, there is a request of price reduction of the image forming apparatus, and it is considered that the cost of members composing the image forming apparatus is cut down. As the measure to down the cost, it is considered that the member made of metal is replaced with the member made of resin such as plastic. For instance, regarding the sheet supply device, it is considered that the member made of resin is used as the lifting plate uses.

When the resin member is applied to the lifting plate of the sheet supply device wherein the peripheral speed of the pickup roller is large as described above, however, the lifting plate is warped by the frictional force. When the warp is generated on the lifting plate in such way, the force for pushing the sheet bundle to the pickup roller is reduced. As a result, the paper feeding pressure is reduced, and the sheet cannot be sent out appropriately. That is to say, an interval between the drive start time of the pickup roller and the finishing time of the sheet feeding gets long. When it is determined that the lifting plate is to be lifted up because the warp occurs on the lifting plate and the force for pushing the sheet bundle to the pickup roller is reduced, the time is required for lifting the lifting plate, too. In this case, the interval between the drive start time of the pickup roller and the finishing time of the sheet feeding become longer than ever.

In the sheet supply device, in order to determine whether or not the sheet is conveyed normally, a sensor is disposed on the downstream side of the pickup roller, and the interval between the drive start time of the pickup roller and the detection time that the sensor detects the sheet fed by the pickup roller is measured. When the measured time is longer than a predetermined maximum time, it is determined the abnormal of sheet feeding (JAM). In the above-mentioned high-speed sheet supply device, there is a tendency that the maximum time is set to be short. Therefore, when the sheet feeding time gets long due to the warp of the lifting plate, the abnormality of sheet feeding is detected frequently.

Since the above-mentioned sheet conveyance failure is caused by the warp of the lifting sheet, even if the method for keeping the feeding pressure constant and the method for increasing the feeding pressure, as disclosed in the foregoing conventional arts, are applied to the sheet supply device, it is not possible to eliminate the sheet failure.

SUMMARY OF THE INVENTION

The sheet supply device related to the present disclosure includes a lifting plate, a driving unit, a pickup roller, a sensor, an abnormality detection unit and an abnormality detecting condition correction unit. The lifting plate is made of a flexible material and liftably mounted on a sheet stacking surface. The driving unit drives up and down the lifting plate. The pickup roller is placed above the lifting plate and feeds the sheet with abutting on an upper surface of the sheets loaded on the lifting plate. The sensor detects an arrival of the sheet fed by the pickup roller on a downstream side of the pickup roller. The abnormality detection unit detects a sheet feeding abnormality of the sheet fed by the pickup roller based on a drive start time of the pickup roller and a time sheet detection by the sensor. The abnormality detecting condition correction unit corrects an abnormality detecting condition of the abnormality detection unit depending on an amount of sheets loaded on the lifting plate.

The other aspect in accordance with the present disclosure provides an image forming apparatus including the above-mentioned sheet supply device.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

The embodiment of the present disclosure will be more specifically explained hereinafter according to the attached drawings. The present disclosure is materialized by a digital multifunction peripheral including a sheet supply device.

Figure 1:
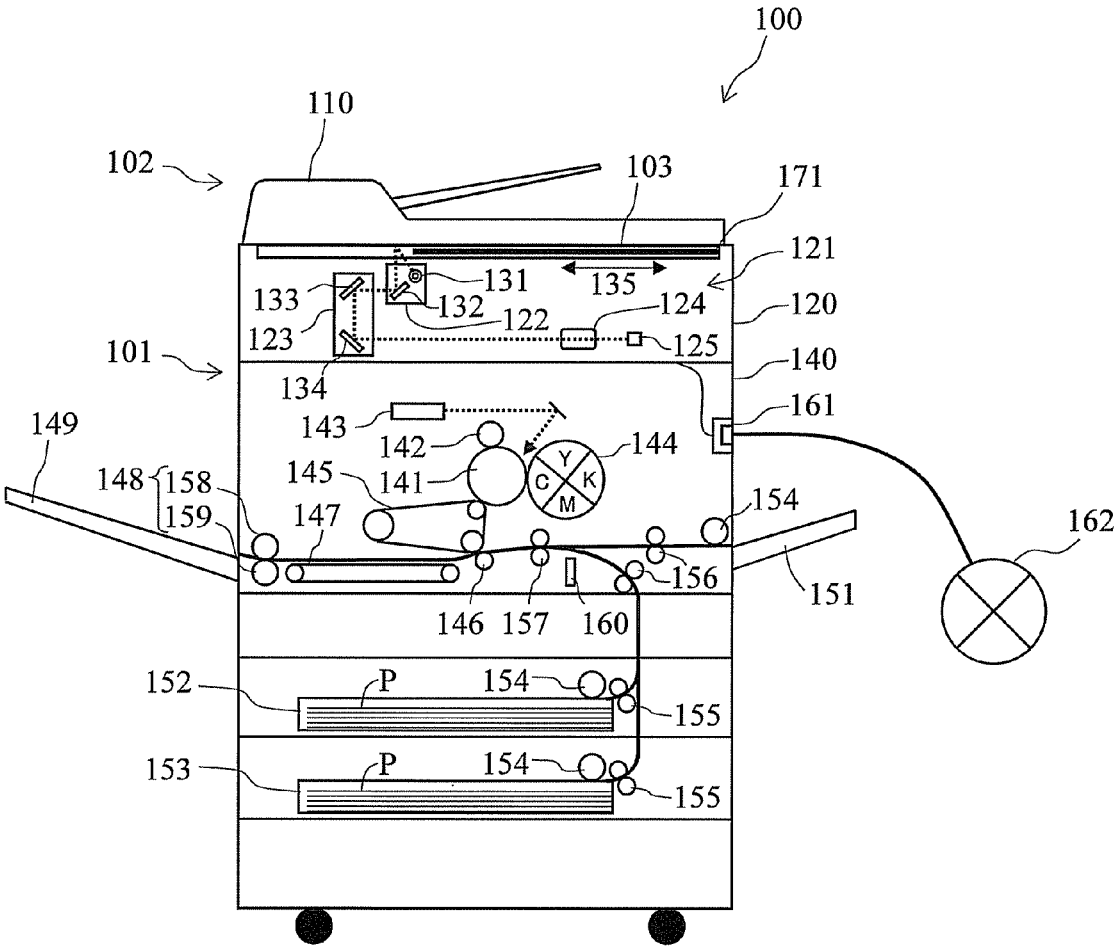
FIG. 1 is a schematic view showing a whole structure of a multifunction peripheral in accordance with an embodiment of the present disclosure.

FIG. 1 is a schematic view showing the whole structure of the digital multifunction peripheral in this embodiment. As shown in FIG. 1, the multifunction peripheral 100 includes a base machine 101 having an image reading unit 120 and an image forming unit 140, and a platen cover 102 placed over the base machine 101. An original plate 103 is arranged on a top surface of the base machine 101. The original plate 103 is opened and closed by the platen cover 102. The platen cover 102 is provided with a document feeder 110. The multifunction peripheral 100 is provided on its front side with an operation panel 171 whereby user can give the multifunction peripheral 100 a copy start instruction and other instructions, and also confirm a status or setting of the multifunction peripheral 100.

The image reading unit 120 is disposed below the original plate 103. The image reading unit 120 reads an image of an original by a scanning optical system 121, and creates digital data (image data) of the image. The original can be placed on the original plate 103 or the document feeder 110. The scanning optical system 121 includes a first carriage 122 and a second carriage 123, and a condenser lens 124. The first carriage 122 is provided with a linear light source 131 and a mirror 132, and the second carriage 123 is provided with mirrors 133 and 134. The light source 131 illuminates the original. The mirrors 132, 133 and 134 guide the light reflected on the original to the condenser lens 124, and the condenser lens 124 forms a light image on a light receiving surface of a line image sensor 125.

In the scanning optical system 121, the first carriage 122 and the second carriage 123 are mounted so as to reciprocate in a sub scanning direction 135. The image sensor 125 can read the image of the original placed on the original plate 103 by moving the first carriage 122 and the second carriage 123 in the sub scanning direction 135. In case of reading the image of the original placed on the document feeder 110, the image reading unit 120 temporarily stops the first carriage 122 and the second carriage 123 so as to correspond to an image reading position, and then reads the image of the original passing through the image reading position by the image sensor 125. The image sensor 125 creates the image data of the original corresponding to each color component of R (red), G (green), and B (blue) based on the light image incident to the light receiving surface, for example. The created image data can be printed out on the paper by the image forming unit 140. The image data also can be sent to other devices (not show) from network interface 161 via network 162.

The image forming unit 140 prints out on papers the image data obtained by the imager reading unit 120 or the image data received from the other device connected with the network 162. The image forming unit 140 is provided with a photosensitive drum 141. The photosensitive drum 141 rotates at a constant speed in one direction. A charging unit 142, an exposing unit 143, a developing unit 144, and an intermediate transfer belt 145 are arranged around the photosensitive drum 141 in order from an upstream side of the rotating direction of the photosensitive drum 141. The charging unit 142 uniformly electrifies a surface of the photosensitive drum 141. The exposing unit 143 irradiates light on the uniformly electrified surface of the photosensitive drum 141 according to the image data, and forms an electrostatic latent image on the photosensitive drum 141. The developing unit 144 adheres the toner to the electrostatic latent image and forms a toner image on the photosensitive drum 141. The intermediate transfer belt 145 transfers the toner image formed on the photosensitive drum 141 to the paper. When the image data is a color image, the intermediate transfer belt 145 transfers each color of the toner image to a same paper. The RGB form of color image is converted to the image data in a form of C (cyan), M (magenta), Y (yellow), and K (black), and each color component of the image data is inputted to the exposing unit 143.

The image forming unit 140 feeds a paper from a manual paper feed tray 151 or paper supply devices (sheet supply devices) 152 and 153 to a transfer unit between the intermediate transfer belt 145 and a transfer roller 146. The various size of papers can be placed on the manual paper feed tray 151 or be accommodated in the paper supply device 152 and 153. The image forming unit 140 selects the paper specified by user or the paper detected automatically corresponding to a size of original, and then feeds the selected paper from the manual paper feed tray 151 or the paper supply device 152 or 153 by a pickup roller 154. The fed paper is conveyed to the transfer unit by a conveyance roller 155, 156 and a resist roller 157. The paper on which the toner image is transferred is conveyed to a fixing unit 148 by a conveyance belt 147. The fixing unit 148 has a fixing roller 158 including a heater and a pressure roller 159, and the toner image is fixed on the paper by the heat and the pressure. The image forming unit 140 ejects the paper passing through the fixing unit 148 to a copy receiving tray 149. Besides, a sensor 160 is disposed nearby the upstream side of the resist roller 157 for detecting an arrival of the paper that is fed by the paper supply device 152 and 153. The sensor 160 can employ the reflective type photosensor (photo reflector) provided with a light emitting unit and a light receiving unit on the same surface, the contactless sensor such as transmissive type photosensor provided with the light emitting unit and the light receiving unit facing each other, or the contact type sensor such as the micro-switch.

Figure 2A:
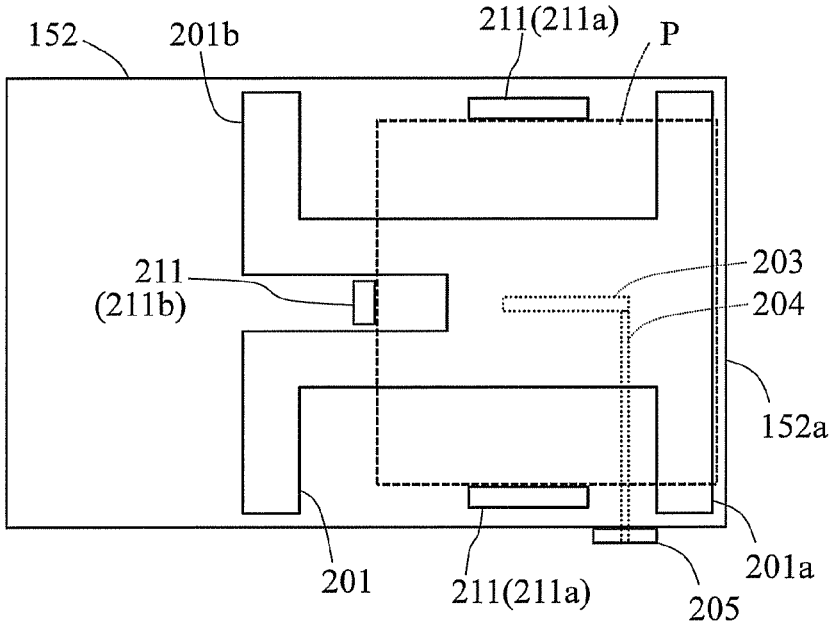
FIG. 2A is a plan view of a paper supply device mounted on the multifunction peripheral in accordance with an embodiment of the present disclosure.
Figure 2B:
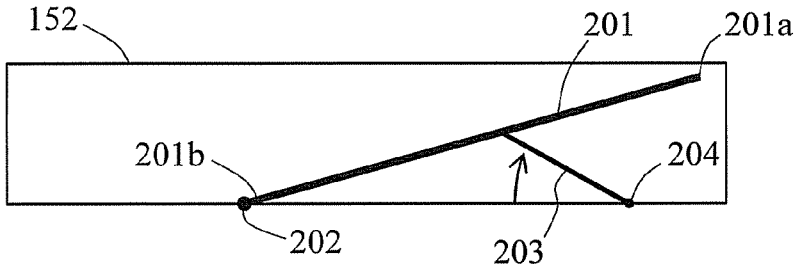
FIG. 2B is a schematic view showing a lifting system of a lifting plate of the paper supply device mounted on the multifunction peripheral in accordance with an embodiment of the present disclosure.
Figure 2C:
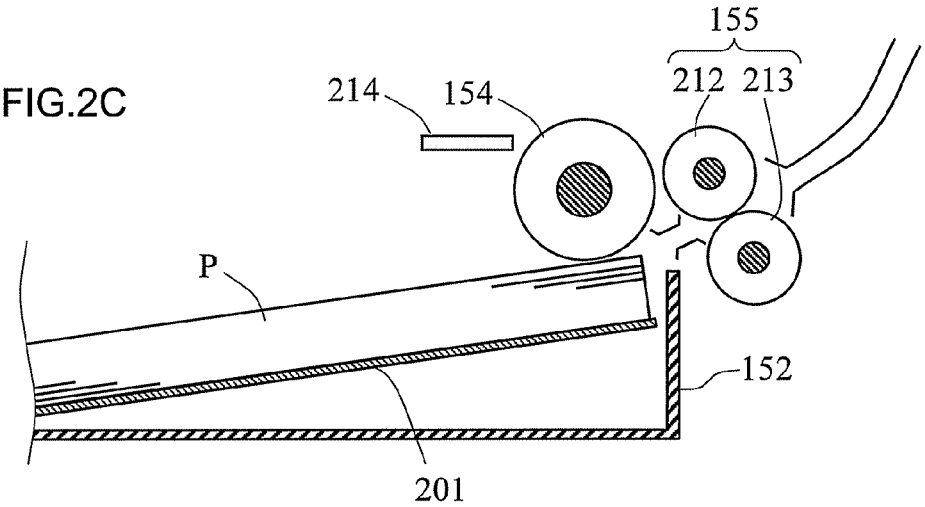
FIG. 2C is an enlarged view showing a vicinity of a pickup roller of the paper supply device mounted on the multifunction peripheral in accordance with an embodiment of the present disclosure.

The structure of the paper supply device 152 and 153 is explained hereinafter based on the paper supply device 152. The paper supply device 152 can accommodate papers P (appropriately referred to "a paper bundle") therein. The paper bundle is loaded on a lifting plate 201 liftably mounted on the paper supply device 152. FIG. 2A to FIG. 2C shows a schematic view showing the paper supply device 152. FIG. 2A is a schematic plan view of a paper loading part (a cassette) of the paper supply device 152. FIG. 2B is a schematic view showing a lifting system (a driving unit) of the lifting plate of the paper supply device 152. FIG. 2C is an enlarged view of a vicinity of the pickup roller 154 of the paper supply device 152 wherein the paper bundle P is loaded.

As shown in FIG. 2A, the lifting plate 201 on which the paper bundle P is loaded is placed on a bottom (a sheet stacking surface) of the paper supply device 152 on a paper feed side. Specifically, a paper feed side end 201*a* of the lifting plate 201 is disposed nearby a paper feed side end 152*a* of the paper supply device 152. The lifting plate 201 is disposed over a width direction (a direction perpendicular to the paper feeding direction) of the paper supply device 152. In the longitudinal direction of the paper supply device 152 (the paper feed direction), the lifting plate 201 is disposed over a specific distance from the side of the pickup roller 154 (two thirds of length of the longitudinal direction) at the bottom of the paper supply device 152.

The paper supply device 152 includes a movable paper guide 211 for prohibiting the moving of the paper P loaded on the lifting plate 201. As shown in FIG. 2A, the paper guide 211 includes a pair of guide plates 211*a* that is movably disposed along the width direction of the paper supply device 152 and a guide plate 211*b* that faces the paper feed side end 152*a* of the paper supply device 152 and movably disposed along the longitudinal direction of the papa supply device 152. The lifting plate 201 includes depressions corresponding to a movable range of each guide plate 211*a* and 211*b* so that the guide plates 211*a* and 211*b* do not interfere with the lifting plate 201 at moving according to the mountable paper size. The lifting plate 201 is made of a flexible material. It is not limited in particular, but the lifting plate 201 in this embodiment is made of plastic resin.

As shown in FIG. 2A and FIG. 2B, the paper feed side end 201*a* of the lifting plate 201 is a floating end that is movable up and down (hereinafter, a "floating end 201*a*"), and the other end 201*b* opposite to the paper feed side end 201*a* is a fixed end (hereinafter, a "fixed end 201*b*"). The fixed end 201*b* is fixed on a rotation shaft 202 disposed on the bottom of the paper supply device 152 and along the width direction of the paper supply device 152. The up and down of the lifting plate 201 is performed by a plate lifting arm (a driving unit) 203 under the lifting plate 201, and an end of the plate lifting arm abuts on the lifting plate 201. In this embodiment, the plate lifting arm 203 is disposed in the center of the width direction of the paper supply device 152. The other end of the plate lifting arm 203 is fixed on the rotation shaft 204 disposed on the bottom of the paper supply device 152 and along the width direction of the paper supply device 152. The plate lifting arm 203 rises from the bottom of the paper supply device 152 along the rotation of the rotation shaft 204 in an arrow direction shown in FIG. 2B. Thereby, the floating end 201*a* of the lifting plate 201 moves upward. Besides, the driving system of the rotation shaft 204 can employ any arbitrary well-known structure. For instance, it may configure that the rotation shaft 204 is connected with a gear group 205 disposed on a side of the paper supply device 152. In this configuration, when the paper supply device 152 is mounted on the multifunction peripheral 100, the gear group 205 is engaged with the gear interlocking with the rotation shaft of the motor of the multifunction peripheral 100. Accordingly, it is possible to transmit the rotational force of the rotation shaft of the motor of the multifunction peripheral 100 to the rotation shaft 204.

In the above-mentioned configuration, the paper bundle P loaded on the lifting plate 201 moves upward along the rotation of the plate lifting arm 203 as shown in FIG. 2C, and the uppermost paper abuts on the pickup roller 154. The pickup roller 154 is disposed so as to float up and down, and moves upward by abutting on the paper bundle P. The upward movement is detected by a sensor 214 like the photosensor so that it is possible to detect an abutment of the pickup roller 154 and the paper. When the uppermost paper abuts on the pickup roller 154, it stops the rotation of the plate lifting arm 203. At this time, the position of the lifting plate 201 is fixed by locking the motor. And in this state, the pickup roller 154 conveys the abutting paper to the downstream side.

As shown in FIG. 2C, since a conveyance roller 155 composed of a feed roller 212 and a separation roller 213 abutting on the feed roller is disposed on the downstream side of the pickup roller 154, even if the drawn papers are two and more, the feed roller 212 and the separation roller 213 separate a first upper paper from the papers and convey it to the downstream side.

Figure 3A:
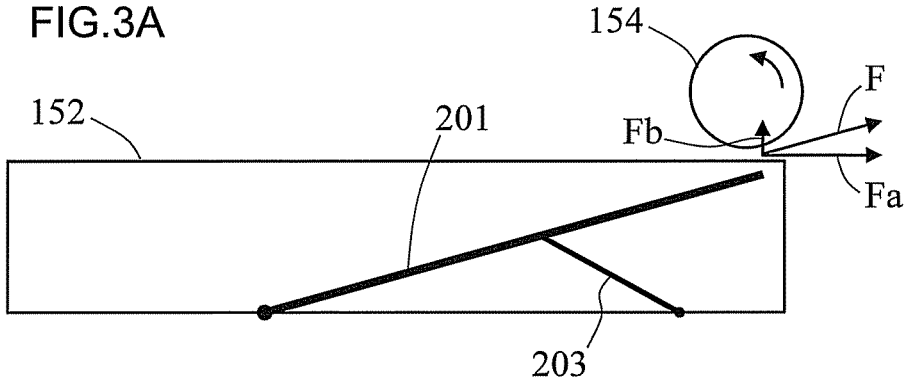
FIG. 3A is a schematic view showing a state that the pickup roller abuts on an uppermost paper on the lifting plate of the paper supply device mounted on the multifunction peripheral in accordance with an embodiment of the present disclosure.
Figure 3B:
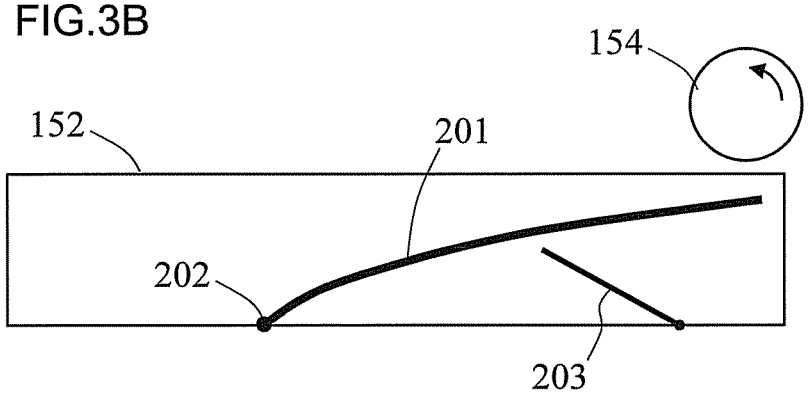
FIG. 3B is a schematic view showing a state that the warp occurs on the lifting plate of the paper supply device mounted on the multifunction peripheral in accordance with an embodiment of the present disclosure.
Figure 3C:
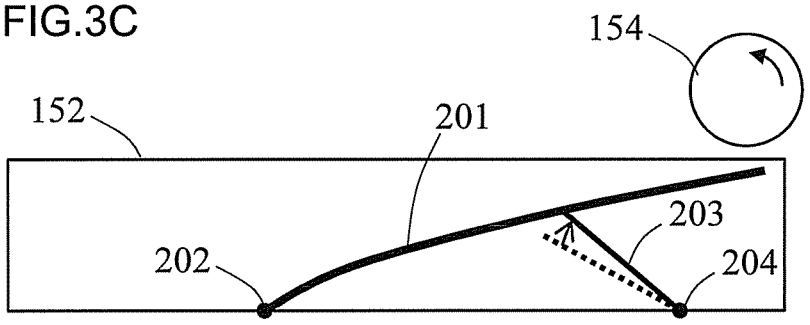
FIG. 3C is a schematic view showing a state following the state shown in FIG. 3B, wherein the lifting plate is lifted up more and the uppermost paper abuts on the pickup roller.

As described above, where the peripheral speed of the pickup roller 154 is large and the lifting plate 201 has flexibility, the warp of the lifting plate occurs. FIG. 3A, FIG. 3B and FIG. 3C are a schematic view showing the factors causing the warp of the lifting plate 201.

As shown in FIG. 3A, when the driving of the pickup roller 154 starts in the state the uppermost paper is abutting on the pickup roller 154, a force F is generated in a direction parallel to the lifting plate 201 due to the frictional force. The force F can be divided into a horizontal component Fa and a vertical component Fb. Specifically, the horizontal force Fa along the paper feed direction acts on the lifting plate 201. In this embodiment, the fixed end 201*b* of the lifting plate 201 is fixed and there are the depressions between the fixed end 201*b* and the floating end 201*a*, as shown in FIG. 2A. In such structure, when the force Fa acts on the lifting plate 201, the length of the width direction of the lifting plate 201 becomes short as shown in FIG. 3B, namely, the warp occurs at the end on the side of the fixed end 201*b* of the depression. The dimension of the depression changes depending on the amount of paper bundle P loaded on the lifting plate 201. There is a tendency that, the warp to occur is small when the amount of paper bundle P is small, and the larger is the amount of paper bundle P, the larger is the warp to occur.

When the warp occurs, the position of the floating end 201*a* of the lifting plate 201 moves downward and the frictional force between the paper bundle P and the pickup roller 154 reduces. As a result, the interval between the drive start time of the pickup roller 154 and the moving start time of the paper becomes long. Additionally, when the warp occurs, there is a possibility that a gap is generated between the lifting plate 201 and the plate lifting arm 203. If the gap is generated, there is a case where the frictional force between the paper bundle P and the pickup roller 154 gets lower and the abutting of the pickup roller 154 and the paper bundle P is not detected by the sensor 214. In such case, the plate lifting arm 203 is driven until the abutting of the pickup roller 154 and the paper bundle P is detected by the sensor 214. As a result, the interval between the drive start time of the pickup roller 154 and the moving start time of the paper gets longer than ever.

Figure 4:
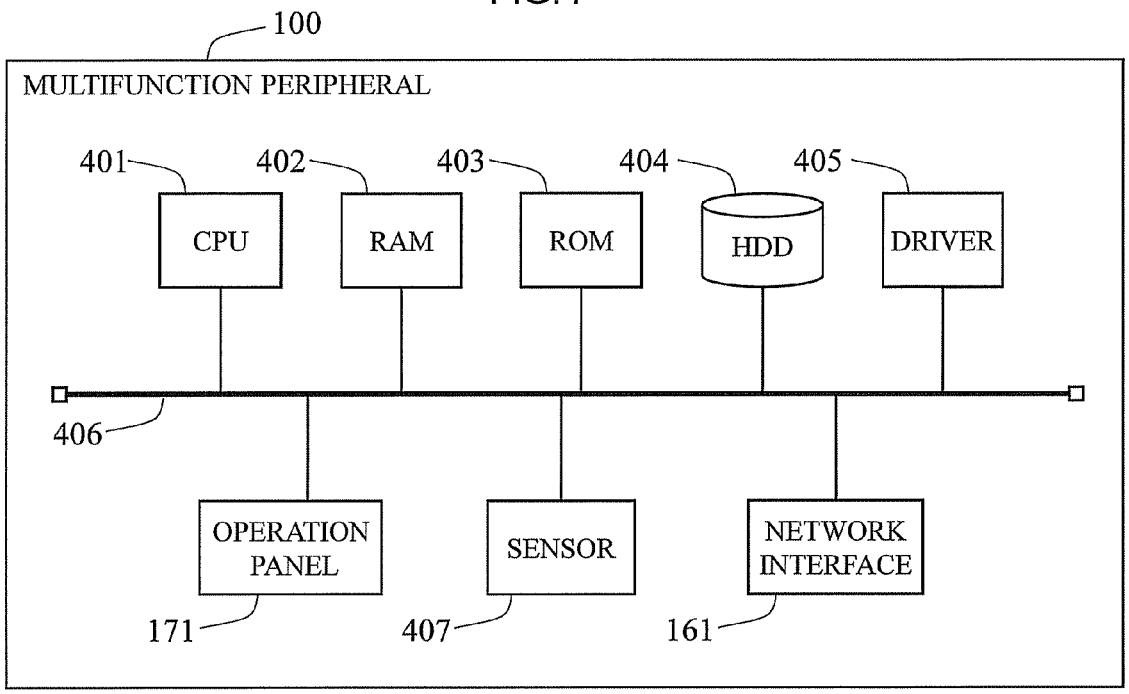
FIG. 4 is a hardware block diagram of the multifunction peripheral in accordance with an embodiment of the present disclosure.

FIG. 4 is a hardware block diagram of control system for the multifunction peripheral. In the multifunction peripheral 100 in this embodiment, CPU (Central Processing Unit) 401, RAM (Random Access Memory) 402, ROM (Read Only Memory) 403, HDD (Hard Disk Drive) 404, and a driver 405 corresponding to driving units of the document feeder 110, the image reading unit 120, and the image forming unit 140 are connected via an internal path 406. ROM 403 and HDD 404 stores programs, and CPU 401 controls the multifunction peripheral 100 according to instructions from the control programs. For instance, CPU 401 uses RAM 402 as a working area, and sends and receives the instruction and the data from and to the driver 405, whereby the working of each driving unit can be controlled. HDD 404 is also used for storing the image data acquired from the image reading unit 120 and the image data received from the outside devise via network interface 161.

The internal path 406 is also connected with the operation panel 171 and various sensors 407. The operation panel 171 receives the user operation, and supplies a signal based on the operation to CPU 401. The operation panel 171 displays an operation screen on a display provide to the operation panel 171 according to the control signal from CPU 401. The sensor 407 includes various kinds of sensors, such as an open and shut detecting sensor for detecting the opening and the shutting of the platen cover 102, an original detecting sensor for detecting an original on the original plate 103, a temperature detecting sensor for detecting the temperature of the fixing unit 148, a paper detecting sensor for detecting the paper or the original to be conveyed, and so on. CPU 401 executes the programs stored in ROM 403, whereby the following means (functional blocks) can be realized and it is possible to control the working of each means according to the signals from these sensors.

Figures 5, 6A, 6B:
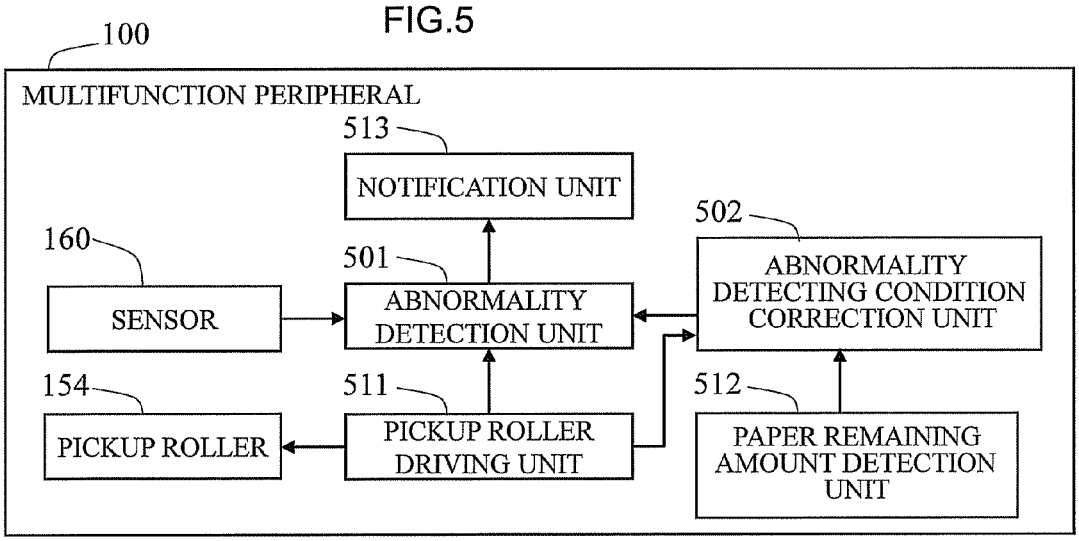
FIG. 5 is a functional block diagram of the multifunction peripheral in accordance with an embodiment of the present disclosure.
FIG. 6A is a table showing an example of a delay time in accordance with an embodiment of the present disclosure.
FIG. 6B is a table showing an example of the delay time taking account of the performance deterioration due to use in accordance with an embodiment of the present disclosure.

FIG. 5 is a functional block diagram of the multifunction peripheral 100 in this embodiment. As shown in FIG. 5, the multifunction peripheral 100 in the embodiment includes an abnormality detection unit 501 and an abnormality detecting condition correction unit 502.

The abnormality detection unit 501 detects the abnormality of the paper feeding by the pickup roller 154 based on a drive start time of the pickup roller 154 and a paper (sheet) detection time by the sensor 160. In this embodiment, an output signal of a pickup roller driving unit 511 for driving the pickup roller 154 and an output signal of the sensor 160 are inputted to the abnormality detection unit 501. The abnormality detection unit 501 acquires the drive start time of the pickup roller 154 based on the output signal of the pickup roller driving unit 511. And the abnormality detection unit 501 monitors whether or not the sensor 160 detects the paper conveyed from the pickup roller 154 until a predetermined normal time (see an abnormality detecting condition: "abnormality detection time" in FIG. 7A and FIG. 7B) has passed after the drive start time of the pickup roller 154. In this embodiment, the sensor 160 is disposed in the vicinity of the upstream side of the resist roller 157, as described above. Besides, the sensor 160 may be disposed at a position on which the arrival of the paper fed by the pickup roller 154 can be detected on the downstream side of the pickup roller 154. Therefore, the sensor may be disposed in the vicinity of the paper supply device 152 (153).

The abnormality detection unit 501, when the sensor 160 does not detect the paper until the normal time has passed, determines that the abnormality occurs at the paper feeding by the pickup roller 154. It is not limited in particular, in this embodiment, when detecting the abnormality, the abnormality detection unit 501 notifies a notification unit 513 of the abnormality occurrence. Upon receipt of the notice, the notification unit 513 notifies the user of the abnormality occurrence in an arbitrary way, such as by displaying a warning of notifying the abnormality on a display of the operation panel 171.

The abnormality detecting condition correction unit 502 corrects abnormality detecting conditions of the abnormality detection unit 501 according to the remaining amount of paper bundle P (sheets) loaded on the lifting plate 201. It is not limited in particular, the abnormality detecting condition correction unit 502 corrects the abnormality detecting conditions by adding a delay time $\alpha$ to the normal time.

The amount of paper bundle P is acquired from a paper remaining amount detection unit 512. The paper remaining amount detection unit 512 can employ a well-known arbitrary structure. For instance, the paper remaining amount detection unit 512 can execute the determination based on the position and upward moving amount of the lifting plate 201 and the position of the uppermost paper. In order to detect the positions, it is possible to use a photosensor like a photoreflector or photointerrupter, the other contactless type sensor, or the contact type sensor like the microswitch.

FIG. 6A is a table showing an example of the delay time $\alpha$ as mentioned above. In this example, the maximum load amount of papers is 300 sheets. As shown in FIG. 6A, when the number of papers is 100 or less, the delay time is 0 ms. When the number of papers is 101 to 150 sheets, the delay time is 5 ms. When the number of papers is 151 to 250 sheets, the delay time is 10 ms. When the number of papers is 251 to 300 sheets, the delay time is 15 ms. Besides, an appropriate value according to the size and material of the lifting plate 201 has been acquired in advance in an experiment, and it may be registered in the abnormality detecting condition correction unit 502 as the delay time $\alpha$.

In addition, the abnormality detecting condition correction unit 502 in the embodiment corrects the abnormality detecting conditions of the abnormality detection unit 501 according to the use of pickup roller 154. As described above, the abnormality detecting condition correction unit 502 corrects the abnormality detecting conditions by adding the delay time $\beta$ to the normal time. The dimension showing how frequently the pickup roller 154 is used can be expressed by an arbitrary parameter expressing the performance degradation (the reduction of the frictional force) by use. For instance, the number of papers conveyed by the pickup roller 154 (the number of printed sheets) may be used as the parameter. The total number of papers in long time use can be counted by a counter provided to the pickup roller drive unit 511.

FIG. 6B is a table showing an example of the delay time $\beta$. As shown in FIG. 6B, in the embodiment, when the number of conveyed papers is 9999 sheets and less, the delay time is 0 ms. When the number of conveyed papers is 10000 to 19999 sheets, the delay time is 10 ms. When the number of conveyed papers is 20000 to 29999 sheets, the delay time is 20 ms. When the number of conveyed papers is 30000 to 39999 sheets, the delay time is 30 ms. When the number of conveyed papers is 40000 to 49999 sheets, the delay time is 40 ms. Besides, an appropriate value according to the size and material of the lifting plate 201 has been acquired in advance in an experiment, and it may be registered in the abnormality detecting condition correction unit 502 as the delay time β. In this example, the upper limit of the number of conveyed papers is not specified, but the upper limit of the number of conveyed papers can be determined by a life (abrasion limit) of the pickup roller 154.

In this embodiment, the abnormality detecting condition correction unit 502 adds a total delay time $Tr=\alpha+\beta$ to the normal time. Besides it can be considered that the warp of the lifting plate 210 would varies according to the lapsed time and the degree of use due to the time-based deterioration depending on the material of the lifting plate 210. Taking the time-based deterioration into consideration, for example, after multiplying the delay time α by a function k1(t) that expresses a dependency of the lapsed time and the degree of use, $Tr=\alpha\times k1(t)+\beta$ may be added to the normal time as the total delay time. Likewise, it can be considered that the warp of the lifting plate 210 varies due to the temperature change depending on the material of the lifting plate 210. Taking the temperature change into consideration, for example, after multiplying the delay time α by a function k2(T) that expresses a temperature dependency, $Tr=\alpha\times k2(T)+\beta$ may be added to the normal time as the total delay time. Furthermore, it is configured in FIG. 6A and FIG. 6B to select a same delay time when the number of papers or the number of conveyed papers is in a specific range, however, it may be configured to select the delay time based on a function that varies the respective delay time according to the number of papers or the number of conveyed papers, (for example, the delay time α (ms)=the number of papers/20, the delay time β (ms)=the number of conveyed papers/1000).

Figure 7A:
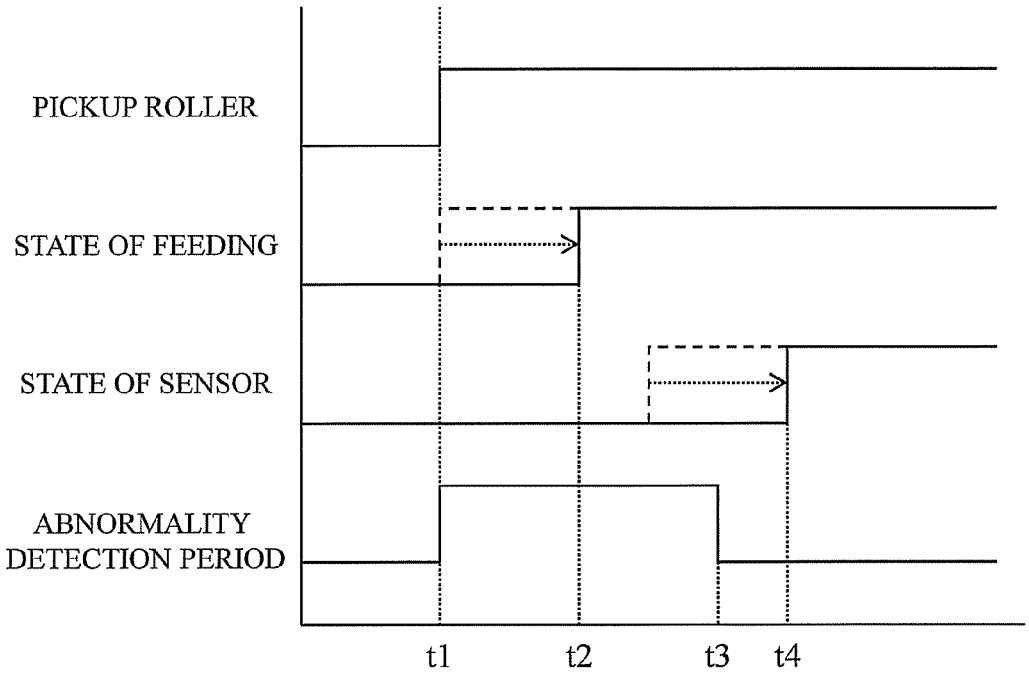
FIG. 7A shows an example of the detection of the abnormality in the conventional device.
Figure 7B:
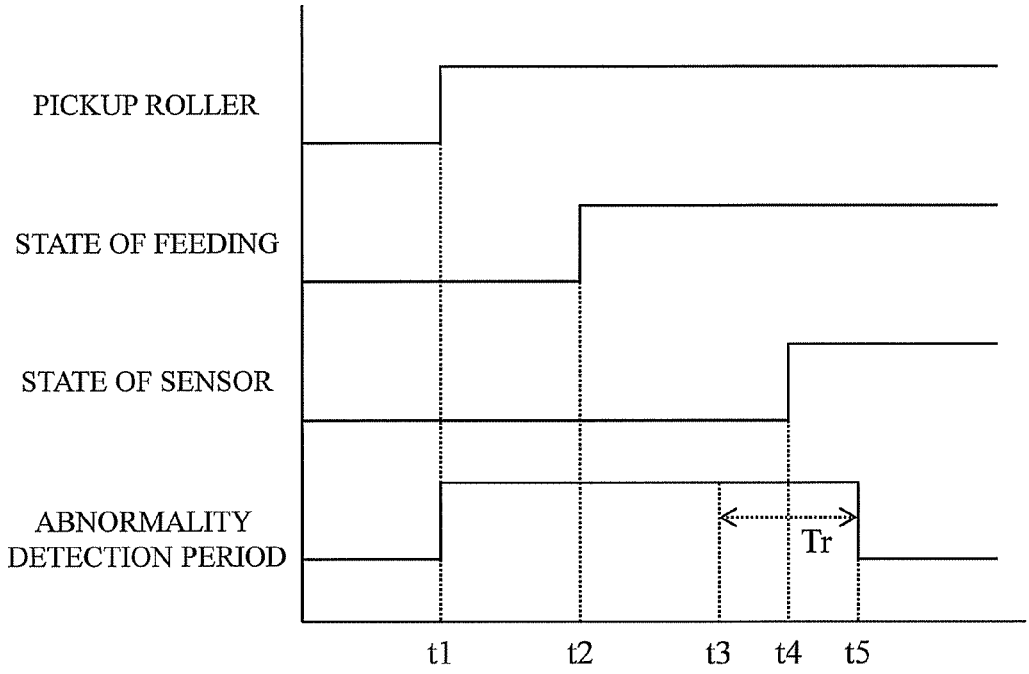
FIG. 7B shows an example of the detection of the abnormality in the present disclosure.

FIG. 7A and FIG. 7B show an example of the abnormality detection executed by the multifunction peripheral 100 in the present disclosure. FIG. 7A corresponds to the conventional abnormality detection and FIG. 7B corresponds to the abnormality detection in the present embodiment. Each of FIG. 7A and FIG. 7B shows a driving state of the pickup roller 154, a state of actual paper feeding carried out by the pickup roller 154, a state of detection by the sensor 160, and an abnormality detection period, in order from a top to down. Regarding the driving state of the pickup roller 154, a High state corresponds to a driving state of the pickup roller, and a Low state corresponds to a stop state of the pickup roller. Regarding the state of actual paper feeding by the pickup roller 154, a High state corresponds to a moving of paper, and a Low state corresponds to a stop of paper. Regarding the detection state by the sensor 160, a High state corresponds to a state of detecting a paper, and a Low state corresponds to a state of no detecting a paper. Regarding the abnormality detection period, a High state corresponds to a normal time, and a Low state corresponds to an abnormal time.

In FIG. 7A, the driving of the pickup roller 154 starts at a time t1. When the frictional force between the paper bundle P and the pickup roller 154 does not reduce, the paper starts moving at the same time of the driving of the pickup roller 154 as shown by a broken line in FIG. 7A. But, when the frictional force between the paper bundle P and the pickup roller 154 reduces due to the warp of the lifting palate 201, the paper starts moving at a time t2 delayed from the drive start of the pickup roller 154, as shown by a solid line in FIG. 7A. Here, where an end of the normal time for the paper detection by the sensor 160 is a time t3, the normal time is a sum of a theoretical time and a margin time for the paper to moving from the paper supply device to the sensor 160. In order to ensure the performance, the margin time is a minimum time. When the delay time (t2−t1) exceeds the margin time, the sensor 160 detects the paper at a time t4 in the abnormal time, as shown in FIG. 7A. In this case, it is determined that the paper feeding is abnormal, and the printing process by the multifunction peripheral stops.

For instance, where the peripheral speed of the pickup roller 154 is 400 mm/s, the delay time caused by the frictional force between the paper bundle P and the pickup roller 154 is 40 ms, the theoretical distance that the paper is conveyed for the delay time is 16 mm. When the margin time is a time corresponding to 12 mm (30 ms), it is determined that the paper feeding is abnormal.

In FIG. 7B, in the same way, the driving of the pickup roller 154 starts at a time t1, and the paper starts moving at a time t2. In the present embodiment, when the moving start of the paper is delayed because the warp occurs on the lifting plate 210, the delay time Tr is added to the normal time. That is to say, the end of the normal time for the sensor 160 to detect the paper is corrected to a time t5 (=t3+Tr). In this case, even when the sensor 160 detects the paper at the time t4, as shown in FIG. 7B, the time t4 is included in the normal time (time from the time t1 to the time t5). Accordingly, the abnormality detection unit 501 does not determine that the paper feeding is abnormal, and the printing process by the multifunction peripheral does not stop. Moreover, since the delay time Tr is determined based on an expected degree of the warp of the lifting plate 201, the normal time is not extended more than required.

Figure 8:
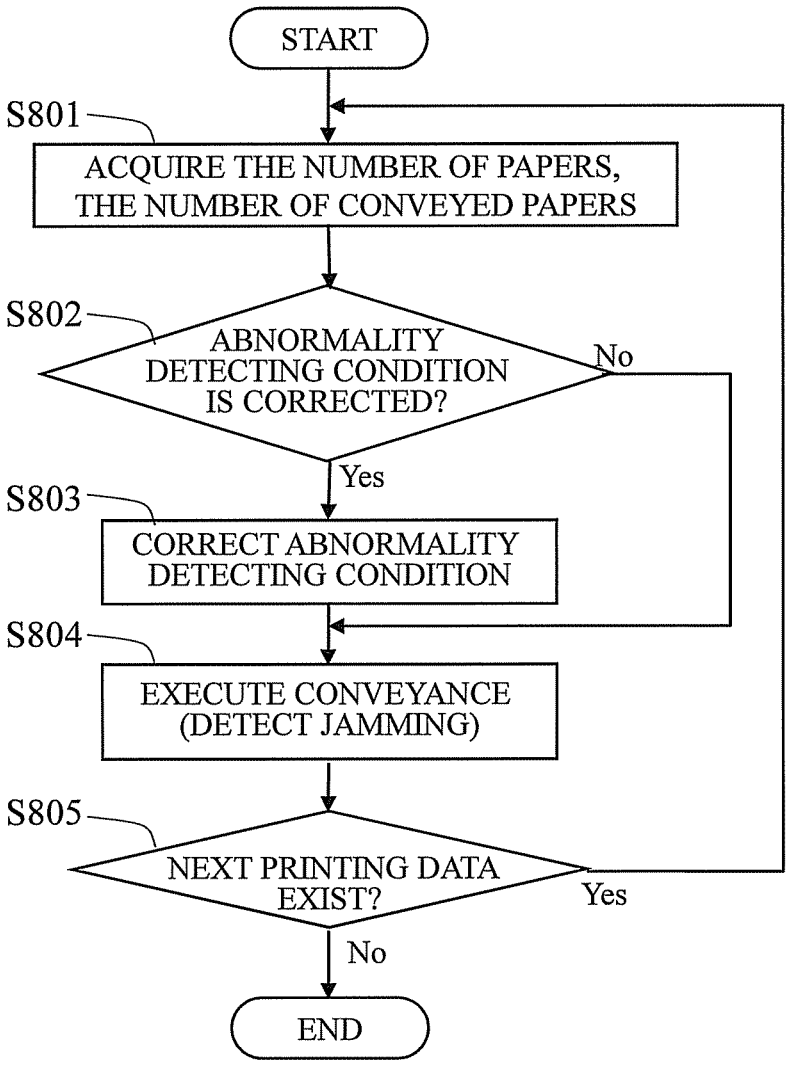
FIG. 8 is a flowchart showing the abnormality detecting procedure executed by the multifunction peripheral in accordance with an embodiment of the present disclosure.

FIG. 8 is a flowchart showing the abnormality detecting procedure executed by the multifunction peripheral 100. The procedure starts when a printing execution instruction is inputted to the multifunction peripheral 100, for example.

When the procedure starts, the abnormality detecting condition correction unit 502 acquires the number of conveyed papers through the pickup roller driving unit 511, and acquires the number of papers on the lifting plate 201 through the paper remaining amount detection unit 512 (step S801). The number of papers may be acquired by the paper remaining amount detection unit 512 at this time, or otherwise, it may be acquired in advance by the paper remaining amount detection unit 512.

The abnormality detecting condition correction unit 502 that acquired the number of conveyed papers and the number of papers on the lifting plate determines if the abnormality detecting condition (the normal time) registered in the abnormality detection unit 501 is necessary to be corrected or not (Step S802). Specifically, the abnormality detecting condition correction unit 502 calculates the delay time Tr, and determines that no correction is required when the time Tr is 0. When the delay time is not equal to 0, the abnormality detecting condition correction unit 502 determines that the correction is required.

When the correction of the abnormality detecting condition is required, the abnormality detecting condition correction unit 502 executes the correction by adding the delay time Tr to the normal time registered in the abnormality detection unit 501 (Step S802 YES, S803). When the correction of the abnormality detecting condition is not required, the abnormality detecting condition correction unit 502 notifies the abnormality detection unit 501 of no correction (Step S802 No).

At correcting the abnormality detecting condition by the abnormality detecting condition correction unit 502 or receiving the notice that no correction is required, the abnormality detection unit 501 detects the conveyance abnormality of conveying paper based on latest abnormality detecting conditions (Step S804). At this time, the pickup roller driving unit 511 increases the number of conveyed papers whenever the paper is conveyed.

The above processing is continued while the unprinted printing data exists (Step S805 Yes, S801). When the unprinted printing data does not exist, the procedure ends (Step S805 No).

As described above, in the multifunction peripheral 100, the abnormality detecting condition of the abnormality detection unit 501 is corrected depending on the number of papers loaded on the lifting plate 201. Specifically, in a situation that the warp occurs on the lifting plate, the normal time is extended depending on the feeding time increasing due to the warp. As a result, the detection of the abnormality can be executed without errors, and it is possible to suppress the productivity deterioration in the condition that the warp does not occur on the lifting plate. Additionally, since the extension time of the normal time is in minimum, when the feeding abnormality occurs in fact, the time of the feeding abnormality is not extended. For instance, when the paper jam occurs, it is possible to minimize the abrasion of the conveyance roller that is caused by continuously transmitting the driving force from the conveyance roller to the jammed papers.

Furthermore, in the embodiment, the skid caused by the abrasion of the pickup roller 154 is also reflected on the delay time Tr, so that it is possible to suppress the erroneous detection of the feeding abnormality more accurately.

Besides, the example that the delay time Tr is added to the normal time was explained in the above embodiment, but instead of changing the period of the normal time (the period between the time t1 and the time t3 in FIG. 7A), it may configure that a starting point of the normal time (time t1) is set back to the delay time Tr (the normal time is shifted). In such configuration, it is possible to provide with the same effect as above.

Besides, the above embodiments do not limit the technical scope of the present disclosure, and other variations and applications can be made in accordance with the scope of the present disclosure, except the foregoing description. For instance, the multifunction peripheral 100 is configured so that the delay time Tr includes the delay time β reflecting the abrasion of the pickup roller 154, but including the delay time β is not indispensable. By correcting the abnormality detecting condition using at least the delay time α, the erroneous detection of conveyance troubles caused by the warp of the lifting plate can be suppressed.

With respect to the flowchart shown in FIG. 8, the order of steps may be changed adequately if it can provide with the same effect. For instance, it is configured in the above embodiment that the abnormality detecting condition correction unit 502 determines whether the correction is made or not, but it may be configured that, without determining whether the correction is made or not, the calculated delay time Tr is always added to the normal time specified by the abnormality detection unit 501.

In the forgoing embodiments, the present disclosure is materialized as the paper supply device for the digital multifunction peripheral, but other than the digital multifunction peripheral, the present disclosure can be applied to the sheet supply device for any image forming apparatus provided with the printer, the copying machine, and the printing function. In addition, the present disclosure can be applied to the sheet supply device for feeding any sheets other than the papers.

What is claimed is:

1. A sheet supply device comprising:

a lifting plate made of a flexible material and liftably mounted on a sheet stacking surface;

a driving unit for driving up and down the lifting plate;

a pickup roller placed above the lifting plate and for feeding the sheet abutting on an upper surface of the sheets loaded on the lifting plate;

a sensor for detecting an arrival of the sheet fed by the pickup roller on a downstream side of the pickup roller;

a paper remaining amount detection unit for determining a remaining amount of sheets loaded on the lifting plate;

a controller for controlling the sheet supply device;

an abnormality detection unit for monitoring whether or not a time between a drive start time of the pickup roller and a sheet detection time by the sensor is within a predetermined normal time; and an abnormality detecting condition correction unit for correcting an abnormality detecting condition concerning the predetermined normal time depending on the remaining amount of sheets detected by the paper remaining amount detection unit when the abnormality detection unit detects an abnormality indicating that the predetermined normal time has passed.

2. The sheet supply device according to claim 1, wherein the larger the remaining amount of sheet, the longer the abnormality detecting condition correction unit makes the predetermined normal time.

3. The sheet supply device according to claim 1, wherein the larger the remaining amount of sheet, the more the abnormality detecting condition correction unit delays the start of the predetermined normal time.

4. The sheet supply device according to claim 2, wherein the abnormality detecting condition correction unit corrects the abnormality detecting condition of the abnormality detection unit depending on a degree of use of the pickup roller.

5. The sheet supply device according to claim 3, wherein the abnormality detecting condition correction unit corrects the abnormality detecting condition of the abnormality detection unit depending on a degree of use of the pickup roller.

6. An image forming apparatus comprising the sheet supply device according to claim 1.

7. The sheet supply device according to claim 1, wherein the lifting plate is made of plastic resin.

8. The sheet supply device according to claim 7, wherein the lifting plate includes a floating end at a downstream of a sheet feeding direction;

a fixed end at an upstream of the sheet feeding direction; and a predetermined width of depression at a center of the lifting plate being provided from the fixed end to the floating end.

* * * * *